US010663889B2

(12) United States Patent
Iwamura

(10) Patent No.: US 10,663,889 B2
(45) Date of Patent: May 26, 2020

(54) DEVELOPING DEVICE AND IMAGE FORMING APPARATUS

(71) Applicant: FUJI XEROX CO., LTD., Tokyo (JP)

(72) Inventor: Takuya Iwamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/253,231

(22) Filed: Jan. 22, 2019

(65) Prior Publication Data

US 2020/0019091 A1 Jan. 16, 2020

(30) Foreign Application Priority Data

Jul. 12, 2018 (JP) ..... 2018-132131

(51) Int. Cl.
*G03G 15/08* (2006.01)

(52) U.S. Cl.
CPC . *G03G 15/0893* (2013.01); *G03G 2215/0838* (2013.01)

(58) Field of Classification Search
CPC ..... G03G 2215/0833; G03G 2215/0822
See application file for complete search history.

(56) References Cited

U.S. PATENT DOCUMENTS 7,502,576 B2 * 3/2009 Kubota ..... G03G 15/0893 399/254
8,208,837 B2 6/2012 Iwamura

FOREIGN PATENT DOCUMENTS

JP 2006113401 4/2006
JP 2007155916 6/2007
JP 2008250290 A * 10/2008
JP 2010211112 9/2010

* cited by examiner

*Primary Examiner* — Clayton E. LaBalle
*Assistant Examiner* — Leon W Rhodes, Jr.
(74) *Attorney, Agent, or Firm* — JCIPRNET

(57) ABSTRACT

A developing device includes a rotating member that delivers developer to a latent image on an image carrier while rotating; a supplying member provided in a supply path extending in an axial direction of the rotating member; a stirring member including a stirring shaft extending in the axial direction and provided in a stirring path extending in the axial direction and arranged side by side with the supply path in a direction intersecting the axial direction, the stirring member stirring the developer while rotating by causing the developer to circulate between the supply path and the stirring path; and a preliminary member provided in a preliminary stirring path into which toner is supplied from an outside and provided by extending an end of the stirring path that is on a side where the developer delivered from the supply member is received by the stirring member, the preliminary member including an extension shaft as an extension of the stirring shaft and a helical transporting blade provided on the extension shaft, the transporting blade being divided into a first transporting blade and a second transporting blade provided across the first transporting blade from the stirring shaft, the preliminary member transporting the toner into the stirring path while rotating.

14 Claims, 12 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2018-132131 filed Jul. 12, 2018.

BACKGROUND

(i) Technical Field

The present disclosure relates to a developing device and an image forming apparatus.

(ii) Related Art

A developer supplying device disclosed by Japanese Unexamined Patent Application Publication No. 2006-113401 includes a body portion, a transporting member, and a toner supplying port. The developer supplying device has a circulation path including a first circulation path provided in proximity to a developing roller, and a second circulation path communicating with the first circulation path at two ends thereof. The transporting member includes a first transporting screw and a second transporting screw provided in the first and second circulation paths, respectively. The first and second transporting screws each having a long narrow shape are provided with helical fins, respectively, and rotate on their own axes.

SUMMARY

A developing device has a stirring path in which developer is stirred, and a supply path from which the developer is supplied to a developing roller. The developer circulates between the stirring path and the supply path forming a circulation path. Furthermore, the developing device has a preliminary stirring path in which toner supplied to the developing device is stirred and simultaneously transported to the circulation path. The preliminary stirring path is provided by extending the stirring path. The preliminary stirring path is provided with a preliminary member including a shaft and a helical transporting blade provided on the shaft. The helical transporting blade provided on the shaft is continuous.

In such a configuration, the developer delivered from the supply path to the stirring path may occasionally advances into the preliminary stirring path (a situation called overrun). If the stirring of such developer having advanced into the preliminary stirring path and fresh toner supplied is insufficient, the density of the resulting toner image may become nonuniform.

Aspects of non-limiting embodiments of the present disclosure relate to a reduction in the occurrence of nonuniformity in the density of a toner image, compared with the case where the helical blade of the preliminary member provided in the preliminary stirring path is continuous.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a developing device including a rotating member that delivers developer to a latent image on an image carrier while rotating; a supplying member provided in a supply path extending in an axial direction of the rotating member; a stirring member including a stirring shaft extending in the axial direction and provided in a stirring path extending in the axial direction and arranged side by side with the supply path in a direction intersecting the axial direction, the stirring member stirring the developer while rotating by causing the developer to circulate between the supply path and the stirring path; and a preliminary member provided in a preliminary stirring path into which toner is supplied from an outside and provided by extending an end of the stirring path that is on a side where the developer delivered from the supply member is received by the stirring member, the preliminary member including an extension shaft as an extension of the stirring shaft and a helical transporting blade provided on the extension shaft, the transporting blade being divided into a first transporting blade and a second transporting blade provided across the first transporting blade from the stirring shaft, the preliminary member transporting the toner into the stirring path while rotating.

BRIEF DESCRIPTION OF THE DRAWINGS

An exemplary embodiment of the present disclosure will be described in detail based on the following figures, wherein.

DETAILED DESCRIPTION

Figure 1:
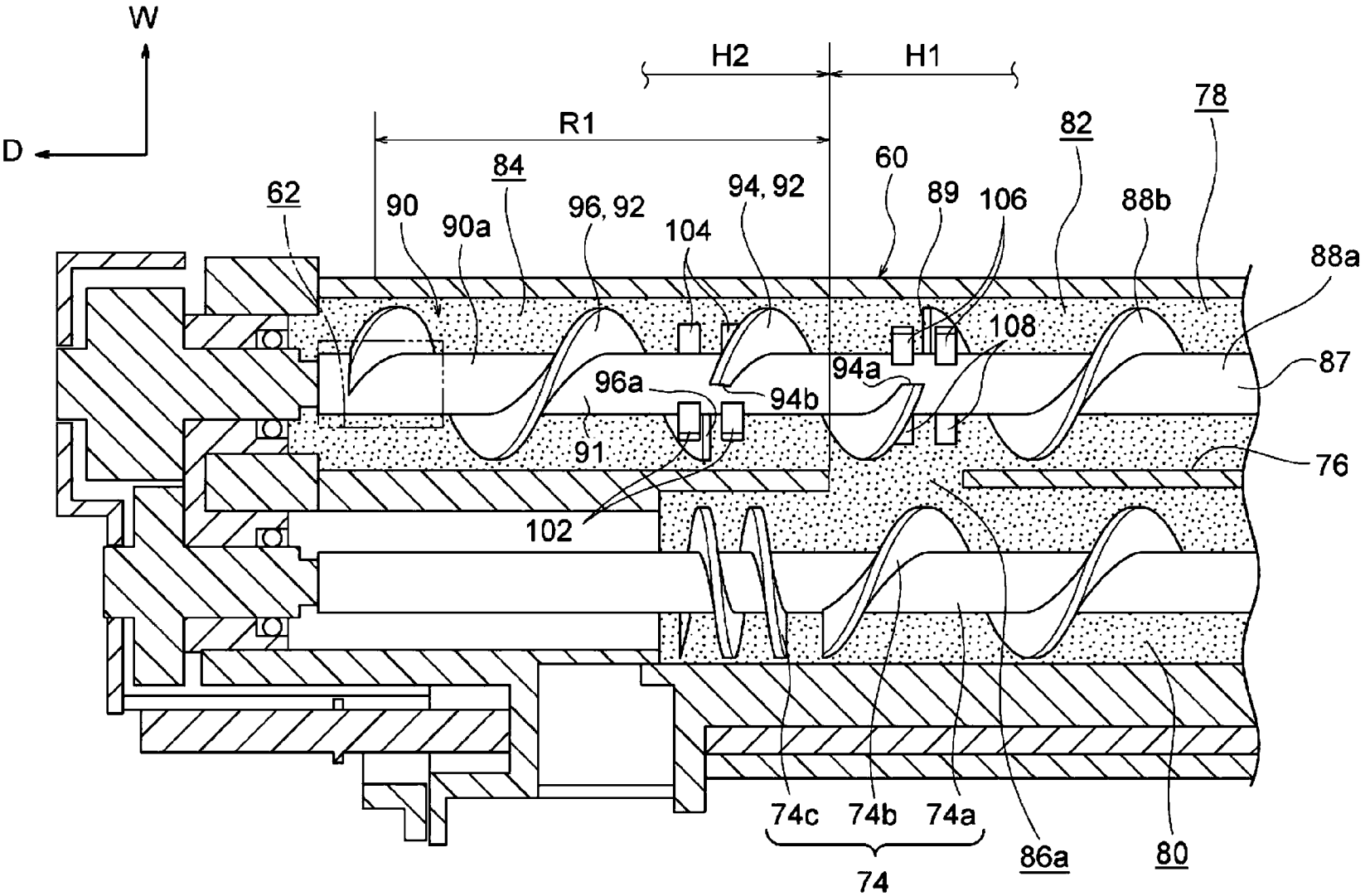
FIG. 1 is a sectional view of a developing device according to an exemplary embodiment of the present disclosure, illustrating a preliminary stirring path and other relevant elements.

An exemplary developing device and an exemplary image forming apparatus according to an exemplary embodiment of the present disclosure will now be described with reference to FIGS. 1 to 9. In the drawings, arrow H represents an apparatus top-bottom direction (a vertical direction), arrow W represents an apparatus width direction (a horizontal direction), and arrow D represents an apparatus depth direction (another horizontal direction).

Image Forming Apparatus 10

Figure 6:
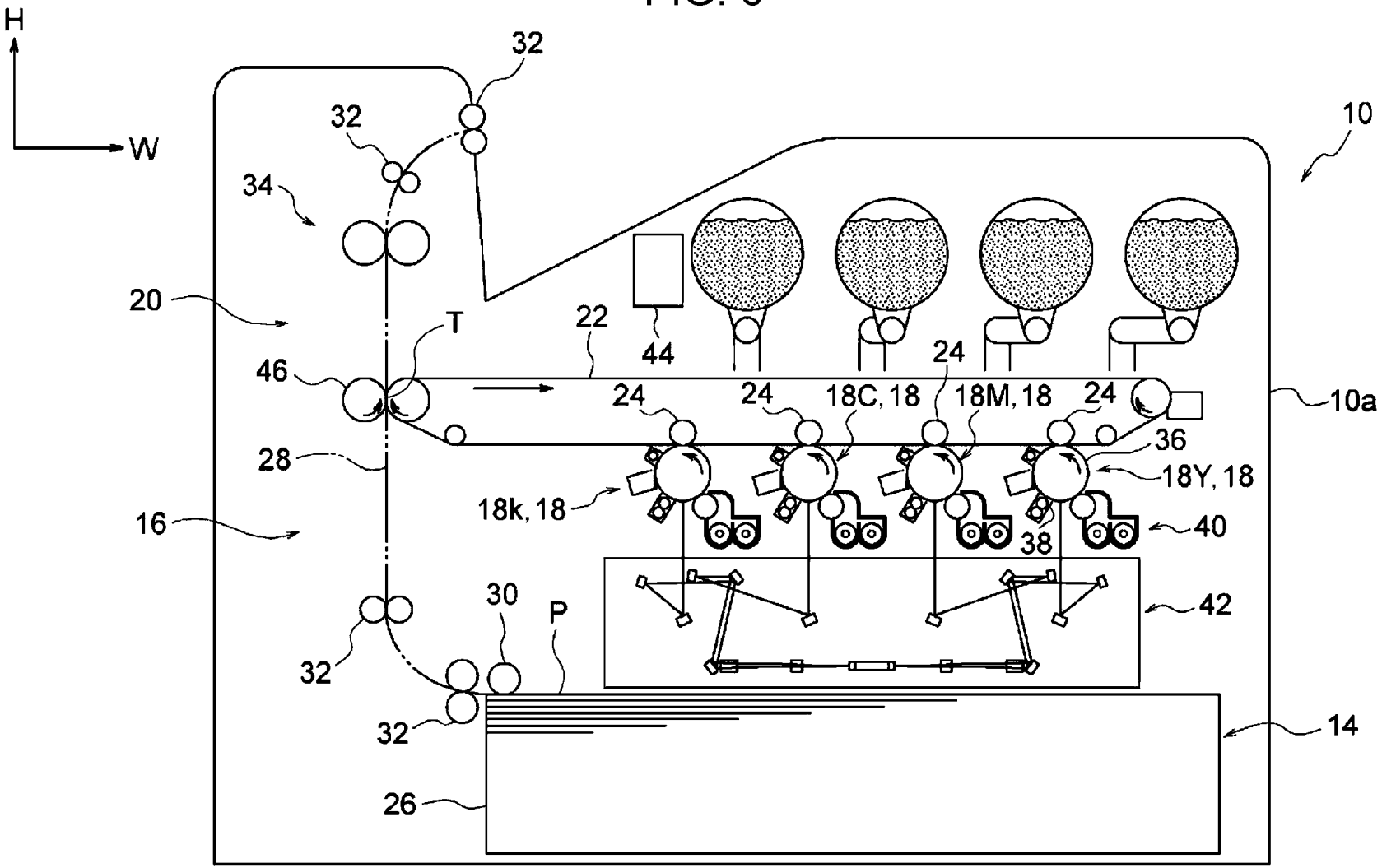
FIG. 6 illustrates an overall configuration of an image forming apparatus according to the exemplary embodiment of the present disclosure.
Figure 7B:
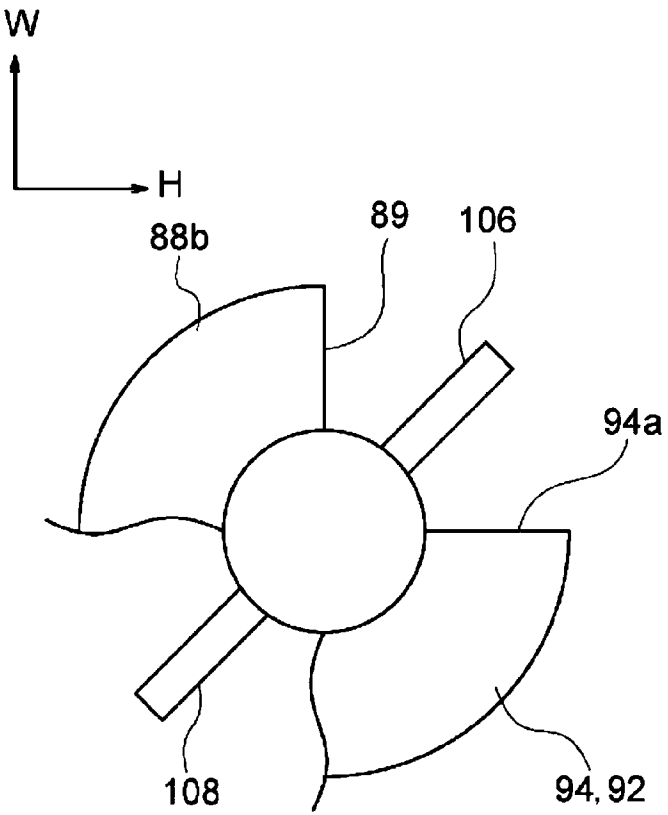
FIGS. 7A and 7B are a front view and a side view, respectively, of the stirring member and the preliminary member included in the developing device according to the exemplary embodiment of the present disclosure.
Figure 7A:
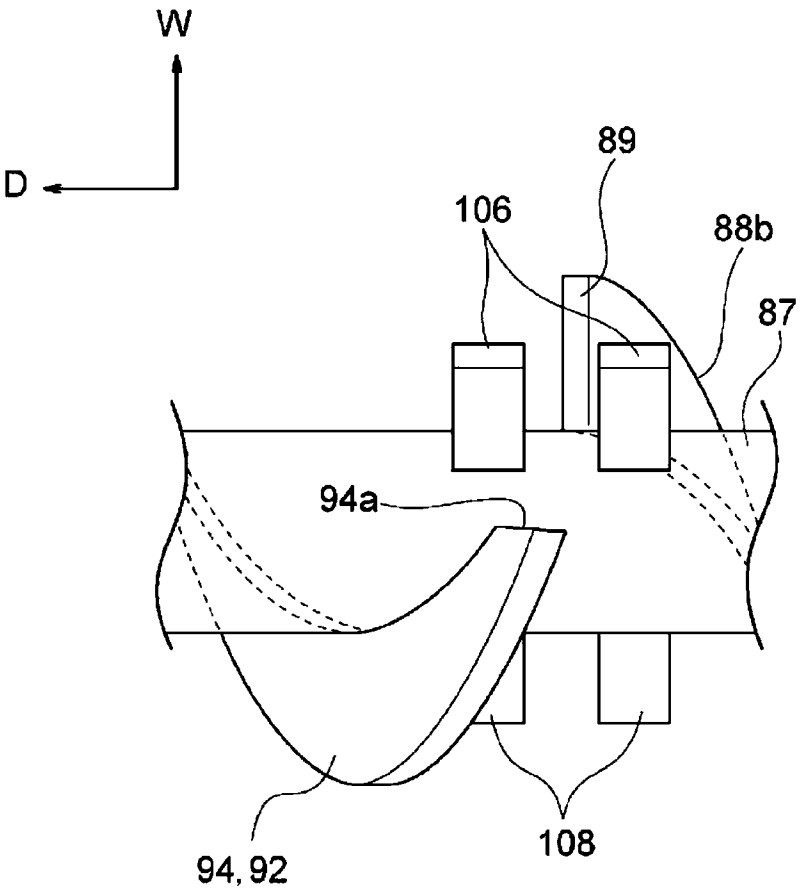
Figure 8B:
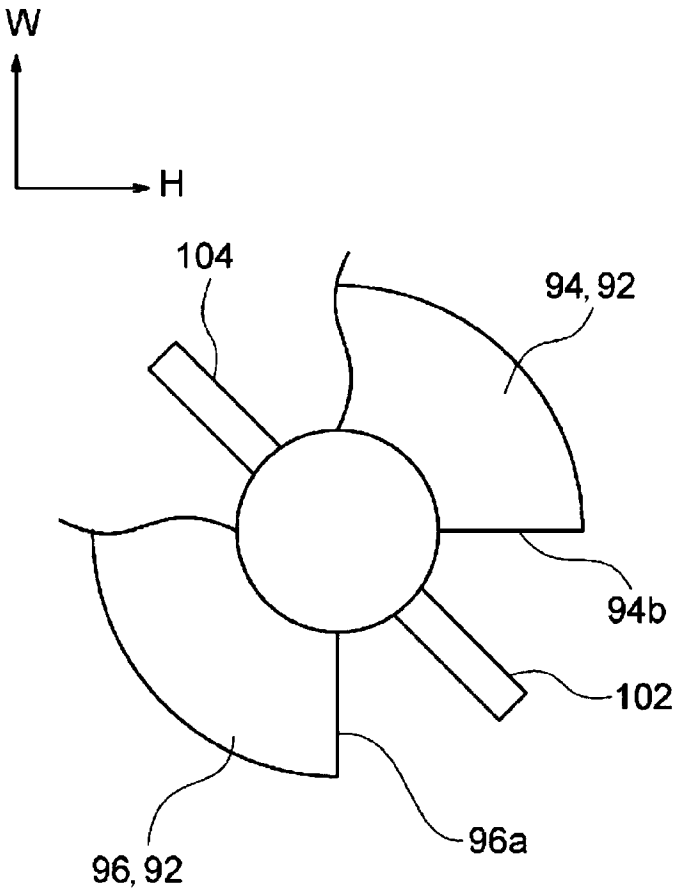
FIGS. 8A and 8B are a front view and a side view, respectively, of the preliminary member included in the developing device according to the exemplary embodiment of the present disclosure.
Figure 8A:
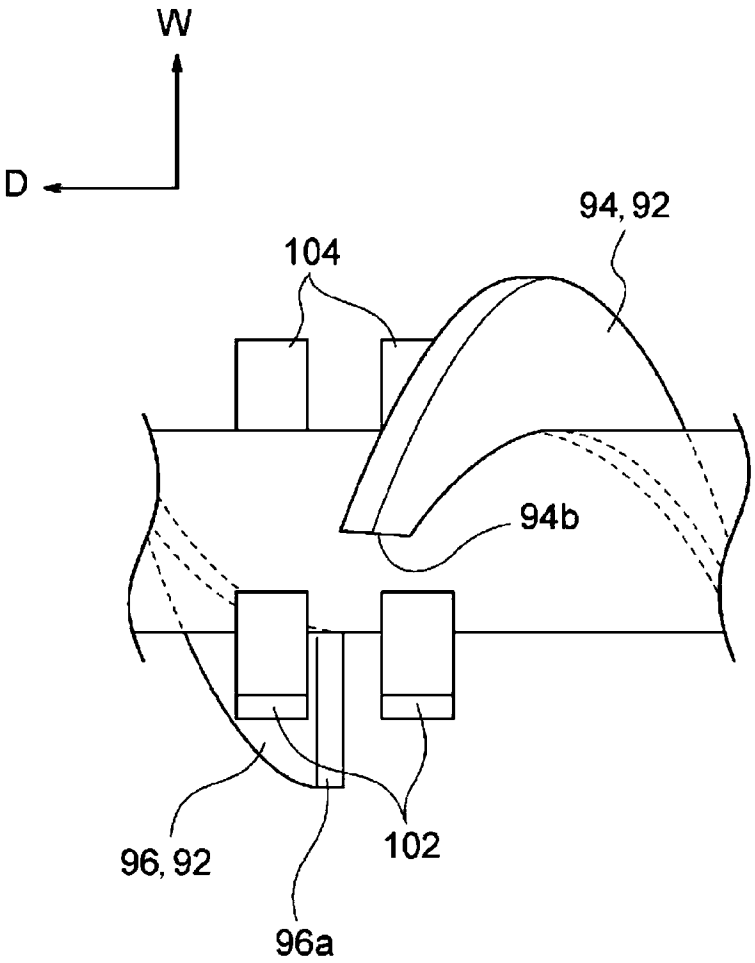

Referring to FIG. 6, an image forming apparatus 10 includes, in order from the bottom to the top thereof in the apparatus top-bottom direction, a container section 14 that contains sheet members P each being a recording medium, a transport section 16 that transports each of the sheet members P from the container section 14, and an image forming section 20 that forms an image on the sheet member P transported from the container section 14 by the transport section 16. The image forming apparatus 10 further includes a controller 44 that controls the above sections.

Container Section

The container section 14 includes a container member 26 that is drawable from an apparatus body 10*a* of the image forming apparatus 10 toward the near side in the apparatus depth direction. The sheet members P are stacked in the container member 26. The container section 14 further includes a feed roller 30 that feeds the top one of the sheet members P stacked in the container member 26 into a transport path 28 included in the transport section 16.

Transport Section

The transport section 16 includes a plurality of pairs of transport rollers 32 that transport the sheet member P along the transport path 28.

Image Forming Section

The image forming section 20 includes four image forming units 18Y, 18M, 18C, and 18K for yellow (Y), magenta (M), cyan (C), and black (K). Hereinafter, if there is no need to distinguish relevant elements from one another by the colors of Y, M, C, and K, the reference characters Y, M, C, and K are omitted occasionally.

Figure 5:
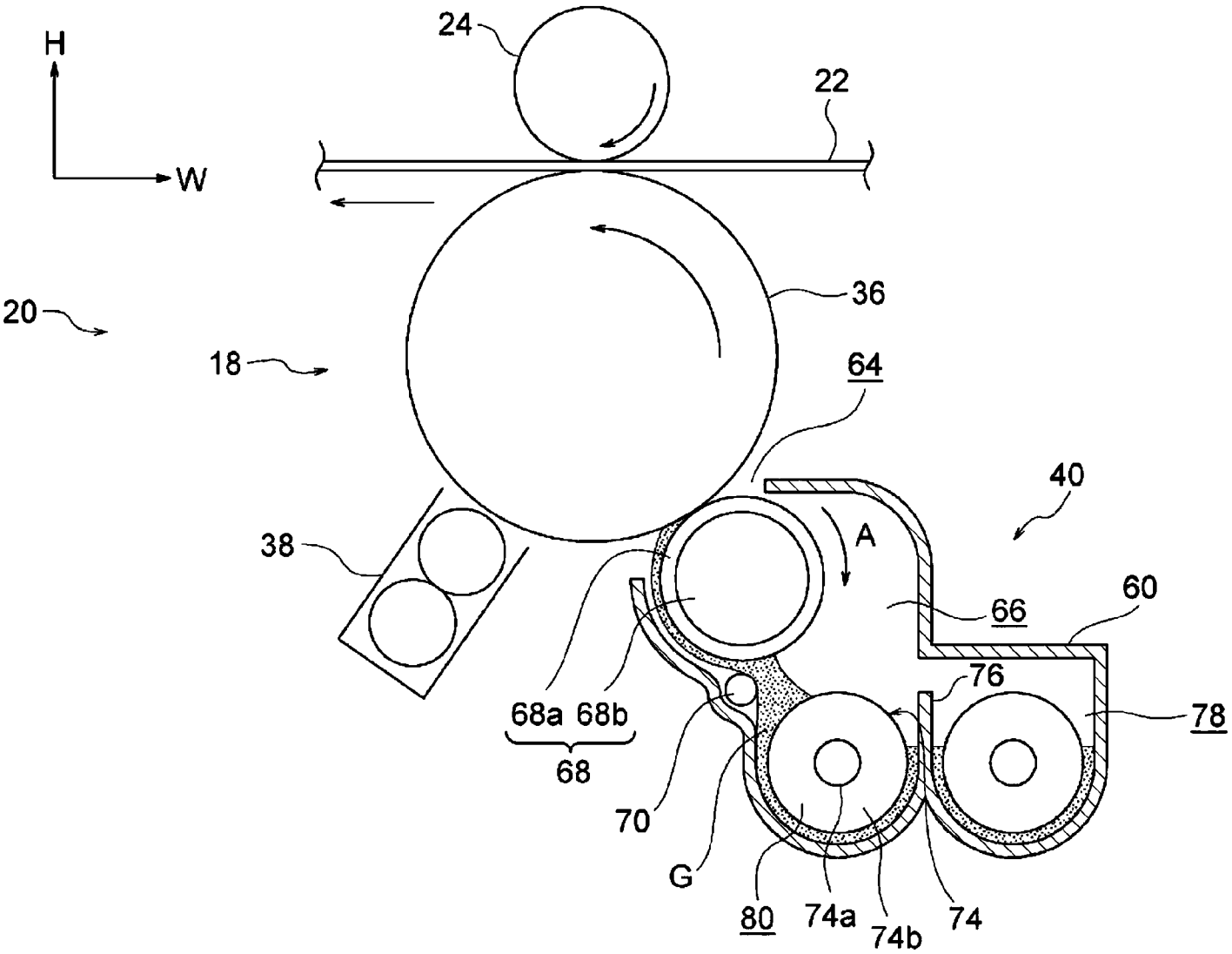
FIG. 5 is a sectional view of the developing device according to the exemplary embodiment of the present disclosure.

The image forming section 20 further includes an exposure device 42 that applies exposure beams for the respective colors to respective image carriers 36 included in the image forming units 18 for the respective colors. Referring to FIG. 5, the image forming units 18 for the respective colors each include the image carrier 36 and a charging member 38 that charges the surface of the image carrier 36. The image forming unit 18 further includes a developing device 40 that develops an electrostatic latent image formed by the exposure beam applied from the exposure device 42 to the charged surface of the image carrier 36 and thus visualizes the electrostatic latent image as a toner image.

Referring to FIG. 6, the image forming section 20 includes an endless transfer belt 22 to which the toner images formed by the image forming units 18 for the respective colors are transferred, and first transfer rollers 24 that transfer the toner images formed by the respective image forming units 18 to the transfer belt 22. The image forming section 20 further includes a second transfer roller 46 that transfers the toner images on the transfer belt 22 to a sheet member P. The image forming section 20 further includes a fixing device 34 that heats and presses the toner images on the sheet member P and thus fixes the toner images to the sheet member P. Details of the developing device 40 will be described separately below.

Operation of Image Forming Apparatus

The image forming apparatus 10 forms an image as follows.

First, the charging members 38 for the respective colors to which a voltage is applied come into contact with the surfaces of the image carriers 36 for the respective colors, thereby negatively charging the surfaces of the image carriers 36 uniformly with a predetermined potential. Subsequently, the exposure device 42 applies exposure beams to the charged surfaces of the image carriers 36 for the respective colors in accordance with pieces of image data inputted thereto from an external device, thereby forming electrostatic latent images.

Thus, electrostatic latent images corresponding to the respective pieces of image data are formed on the surfaces of the respective image carriers 36. Then, the developing devices 40 for the respective colors develop the electrostatic latent images and thus visualizes the electrostatic latent images as toner images, respectively. Furthermore, the first transfer rollers 24 transfer the toner images on the surfaces of the image carriers 36 for the respective colors to the transfer belt 22.

Meanwhile, the feed roller 30 feeds the top one of the sheet members P stacked in the container member 26 into the transport path 28 toward a transfer position T where the transfer belt 22 and the second transfer roller 46 are in contact with each other. At the transfer position T, the sheet member P is nipped between the second transfer roller 46 and the transfer belt 22, whereby the toner images on the transfer belt 22 are transferred to the sheet member P.

Then, the fixing device 34 fixes the toner images on the sheet member P to the sheet member P. The sheet member P thus having the fixed toner images is discharged to the outside of the apparatus body 10*a* by the pairs of transport rollers 32.

Featured Configuration

A configuration of the developing device 40 according to the present exemplary embodiment will now be described.

Referring to FIG. 5, the developing device 40 includes a housing 60 that houses relevant elements. The housing 60 has thereinside a developer storing chamber 66 in which developer G containing toner T and carrier C is storable.

Housing 60

Referring to FIG. 5, the housing 60 has an open part 64 that opens toward the image carrier 36. The housing 60 houses a developing roller 68. Part of the developing roller 68 is exposed from the open part 64. The developing roller 68 is oriented such that the axial direction thereof corresponds to the apparatus depth direction. The developing roller 68 delivers the developer G to the image carrier 36. The developing roller 68 is an exemplary rotating member.

The housing 60 has thereinside a supply path 80 in which the developer G is transported and from which the developer G is supplied to the developing roller 68. The supply path 80 extends in the apparatus depth direction. Specifically, seen in the apparatus depth direction, the supply path 80 is provided across the developing roller 68 from the image carrier 36. The supply path 80 has a U-shaped section, with the top thereof being open.

Figure 3:
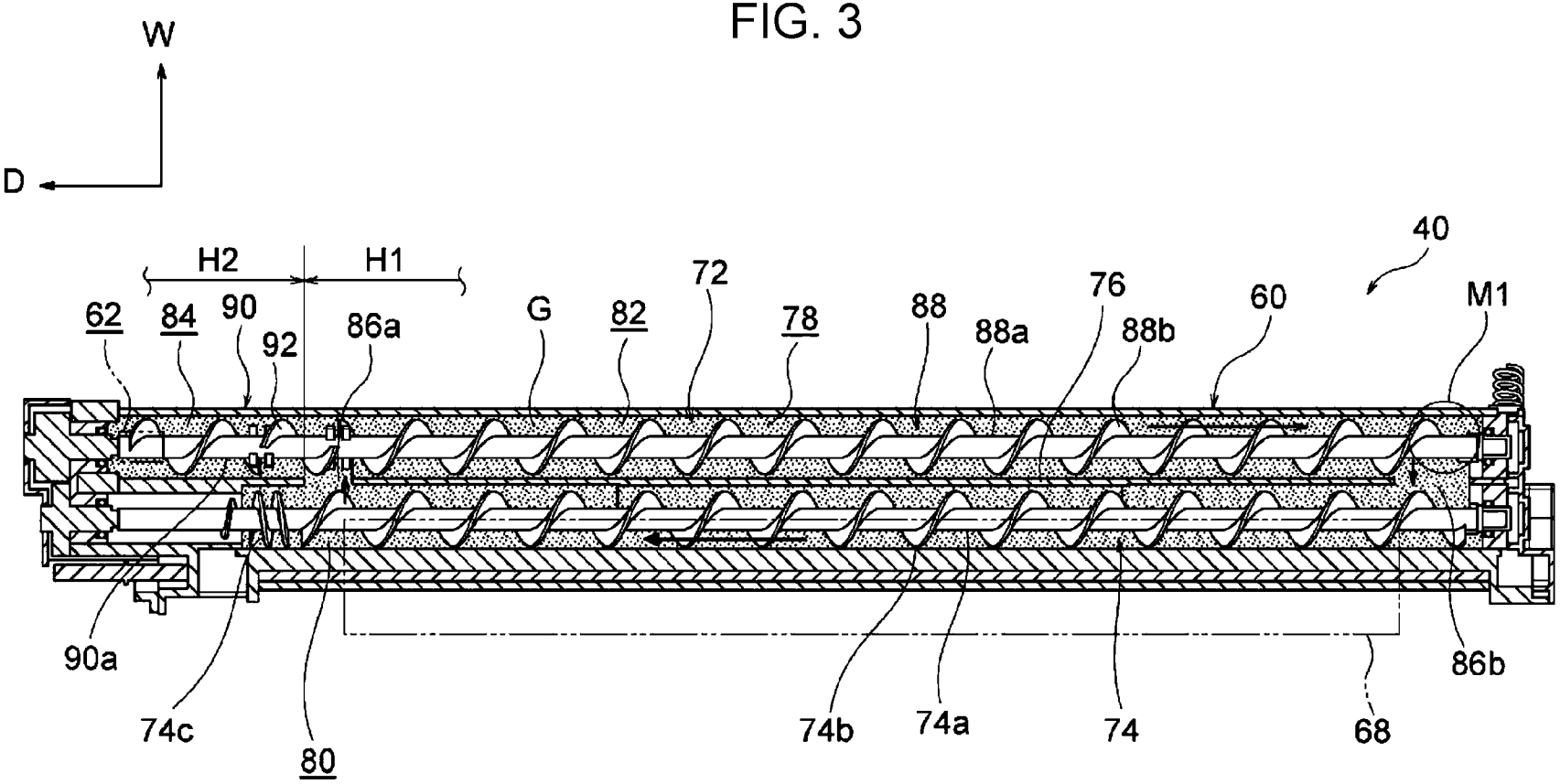
FIG. 3 is a sectional view of the developing device according to the exemplary embodiment of the present disclosure, illustrating a supply path, a stirring path, the preliminary stirring path, and other relevant elements.

Referring to FIG. 3, the supply path 80 is provided with a supplying member 74 extending in the apparatus depth direction. The supplying member 74 transports, when rotated, the developer G from the near side (the right side in FIG. 3) toward the far side (the left side in FIG. 3) in the apparatus depth direction and supplies the developer G to the developing roller 68.

Referring to FIG. 5, the housing 60 has thereinside a transport path 78 extending in the apparatus depth direction and in which the developer G is stirred while being transported. Specifically, the transport path 78 is positioned farther from the developing roller 68 than the supply path 80 and side by side with the supply path 80 in the apparatus width direction (a direction intersecting the axial direction of the developing roller 68). The transport path 78 has a U-shaped section, with the top thereof being open.

Referring to FIG. 3, the transport path 78 extending in the apparatus depth direction includes a stirring path 82 in which the developer G is stirred while being transported, and a preliminary stirring path 84 that receives fresh toner T supplied into the housing 60 from the outside. The preliminary stirring path 84 is provided by extending an end of the stirring path 82 that is on the far side in the apparatus depth direction, i.e., a side where the developer G delivered from the supplying member 74 is received (details will be described separately below).

The preliminary stirring path 84 is shorter than the stirring path 82 in the apparatus depth direction. The stirring path 82 and the preliminary stirring path 84 are continuous with each other in that order from the near side toward the far side in the apparatus depth direction. Specifically, a portion of the transport path 78 that is side by side with the supply path 80 in the apparatus width direction is defined as the stirring path 82. In other words, the stirring path 82 is side by side with the supply path 80 in the apparatus width direction.

The transport path 78 is provided with a transporting member 72 extending in the apparatus depth direction. The transporting member 72 transports, when rotated, the developer G from the far side (the left side in FIG. 3) toward the near side (the right side in FIG. 3) in the apparatus depth direction, thereby stirring the developer G.

The housing 60 has a toner supply port 62 through which fresh toner T is supplied from the outside into the housing 60. The toner supply port 62 is provided at the top of a portion of the preliminary stirring path 84 that is on the far side in the apparatus depth direction. In other words, fresh toner T supplied into the housing 60 through the toner supply port 62 is received by the portion of the preliminary stirring path 84 that is on the far side in the apparatus depth direction. That is, the toner supply port 62 is provided at the top of a portion of the preliminary stirring path 84 that is farther from the stirring path 82.

The housing 60 includes a partition member 76 extending in the apparatus depth direction and that separates the supply path 80 and the stirring path 82 from each other except the two ends thereof in the apparatus depth direction. The partition member 76 has a passageway 86*a* on the far side in the apparatus depth direction. The passageway 86*a* allows the developer G to move between the supply path 80 and the stirring path 82. The partition member 76 has another passageway 86*b* on the near side in the apparatus depth direction. The passageway 86*b* also allows the developer G to move between the supply path 80 and the stirring path 82. The passageway 86*a* and the passageway 86*b* are each an exemplary opening.

A portion (an area H1 illustrated in FIG. 3) of the transport path 78 that extends toward the near side in the apparatus depth direction from an end of the passageway 86*a* that is on the far side in the apparatus depth direction is defined as the stirring path 82. Whereas, a portion (an area H2 illustrated in FIG. 3) of the transport path 78 that extends toward the far side in the apparatus depth direction from the end of the stirring path 82 is defined as the preliminary stirring path 84.

Developing Roller 68

Referring to FIG. 5, the developing roller 68 extends in the apparatus depth direction and includes an electrically conductive cylindrical sleeve 68*a* rotatably supported by the housing 60, and a round columnar magnet roller 68*b* fixed to the housing 60. The sleeve 68*a* is provided with a gear (not illustrated) fixed at an end of a rotating shaft thereof. A rotational force generated by a motor (not illustrated) is transmitted to the gear, and the gear causes the sleeve 68*a* to rotate in a direction of arrow A illustrated in FIG. 5.

A regulating member 70 that regulates the amount of developer G on the developing roller 68 is provided at a position facing the developing roller 68 and across the developing roller 68 from the image carrier 36.

In such a configuration, the developing roller 68 magnetically attracts the carrier C contained in the developer G and forms a magnetic brush of developer G on the surface thereof. The developer G whose amount has been regulated by the regulating member 70 is transported to a position facing the image carrier 36. Then, the electrostatic latent image on the image carrier 36 is visualized as a toner image with the developer G on the developing roller 68.

Supplying Member 74

Referring to FIG. 3, the supplying member 74 is provided in the supply path 80. The supplying member 74 includes a supplying shaft 74*a* extending in the apparatus depth direction, a helical supplying blade 74*b* provided around the supplying shaft 74*a*, and a reversal blade 74*c* that is helical in a direction opposite to the direction in which the supplying blade 74*b* is helical.

The supplying shaft 74*a* is rotatably supported at two ends thereof by the wall of the housing 60 and is provided with a gear (not illustrated) fixed at one end thereof. A rotational force is transmitted to the gear from a drive source.

The supplying blade 74*b* provided around the supplying shaft 74*a* extends from a position facing the passageway 86*a* in the apparatus width direction to a position facing the passageway 86*b* in the apparatus width direction.

The reversal blade 74*c* is provided on the far side with respect to the supplying blade 74*b* in the apparatus depth direction. In the present exemplary embodiment, the reversal blade 74*c* and the supplying blade 74*b* have the same outside diameter. However, the pitch of the reversal blade 74*c* is smaller than the pitch of the supplying blade 74*b*.

In such a configuration, the portion of the rotating supplying member 74 where the supplying blade 74*b* is provided transports the developer G in the supply path 80 from the near side toward the far side in the apparatus depth direction while stirring the developer G, and supplies the developer G to the developing roller 68. The portion of the rotating supplying member 74 where the reversal blade 74*c* is provided changes the direction of transport of the developer G transported thereto by the portion where the supplying blade 74*b* is provided, and delivers the developer G to a stirring member 88, included in the transporting member 72, through the passageway 86*a*.

Transporting Member 72

Referring to FIG. 3, the transporting member 72 is provided in the transport path 78 including the stirring path 82 and the preliminary stirring path 84. The transporting member 72 includes the stirring member 88 extending in the stirring path 82, and a preliminary member 90 extending in the preliminary stirring path 84.

Stirring Member 88

Referring to FIG. 3, the stirring member 88 includes a stirring shaft 88*a* extending in the apparatus depth direction, and a helical stirring blade 88*b* provided around the stirring shaft 88*a*.

An end of the stirring shaft 88*a* that is on the near side in the apparatus depth direction is rotatably supported by the wall of the housing 60. An end of the stirring shaft 88*a* that is on the far side in the apparatus depth direction is connected to an extension shaft 90*a* included in the preliminary member 90. In other words, the extension shaft 90*a* is provided by extending the end of the stirring member 88 that is on the far side in the apparatus depth direction. That is, the stirring shaft 88*a* and the extension shaft 90*a* are integrated with each other. An end of the extension shaft 90*a* that is on the far side in the apparatus depth direction is rotatably supported by the wall of the housing 60.

The stirring shaft 88*a* is provided with a gear (not illustrated) fixed at the end thereof on the far side in the apparatus depth direction. A rotational force is transmitted to the gear from a drive source. In the present exemplary embodiment, the stirring shaft 88*a* and the supplying shaft 74*a* have the same outside diameter, and the stirring blade 88*b* and the supplying blade 74*b* have the same outside diameter. Furthermore, the pitch of the stirring blade 88*b* is the same as the pitch of the supplying blade 74*b*.

Referring to FIG. 1, and end of the stirring blade 88*b* on the far side (the side where the preliminary stirring path 84 is provided) in the apparatus depth direction reaches a position facing a central part of the passageway 86*a* in the apparatus width direction. Furthermore, seen in the axial direction, an end surface 89 of the stirring blade 88*b* that is on a side nearer to the preliminary stirring path 84 extends in the radial direction of the stirring shaft 88*a*. The end surface 89 is an exemplary end part.

In such a configuration, referring to FIG. 3, the rotating stirring member 88 that is stirring the developer G transports the developer G received from the supplying member 74 through the passageway 86*a* provided on the far side in the apparatus depth direction. Specifically, the rotating stirring member 88 that is stirring the developer G transports the developer G from the far side toward the near side in the apparatus depth direction.

The developer G transported by the stirring member 88 is stopped by the wall surface of the housing 60. Hence, the rotating stirring member 88 delivers the developer G to the portion of the supplying member 74 where the supplying blade 74*b* is provided through the passageway 86*b* provided on the near side in the apparatus depth direction. Thus, the developer G circulates between the supply path 80 and the stirring path 82 (as represented by arrows in FIG. 3).

Meanwhile, some of the developer G that is moving from the rotating supplying member 74 toward the stirring path 82 through the passageway 86*a* is not delivered to the stirring member 88 but advances into an allowance area R1 (a so-called overrun area) provided in the preliminary stirring path 84.

Figure 4:
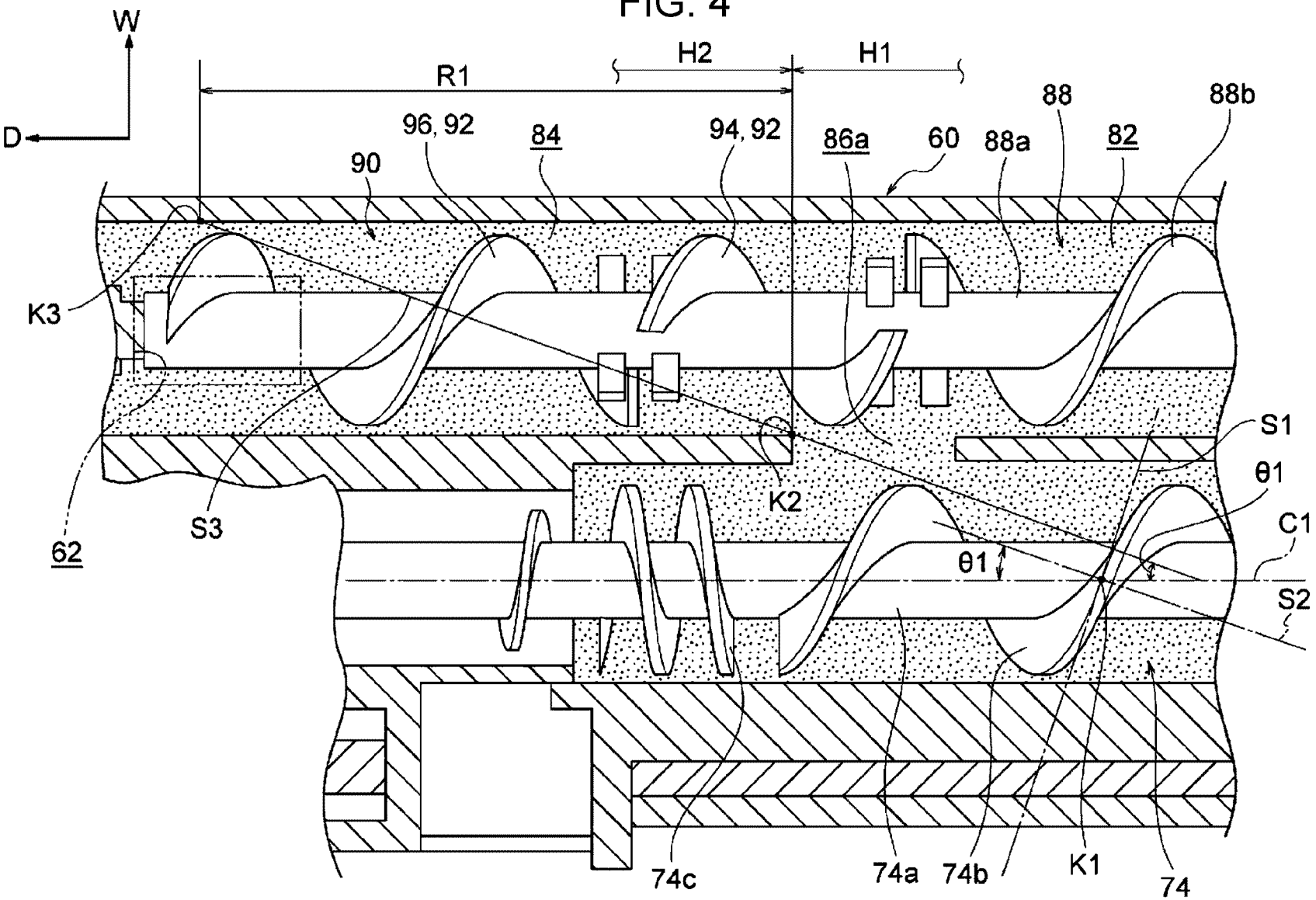
FIG. 4 is another sectional view of the developing device according to the exemplary embodiment of the present disclosure, illustrating the preliminary stirring path and other relevant elements.

The allowance area R1 will now be described with reference to FIG. 4. In top view, a tangent (denoted by S1 in FIG. 4) to the peripheral edge of the supplying blade 74*b* is drawn at an intersection K1 where a center line C1 of the supplying shaft 74*a* and the peripheral edge of the supplying blade 74*b* meet. Furthermore, in top view, a line (denoted by S2 in FIG. 4) orthogonal to the tangent S1 is drawn at the intersection K1. Then, an acute angle (denoted by θ1 in FIG. 4) formed between the line S2 and the center line C1 is calculated.

Furthermore, in top view, a line (denoted by S3 in FIG. 4) passing an edge K2 of the passageway 86*a* that is on the side of the preliminary stirring path 84 and forming the angle θ1 with respect to the center line C1 is drawn. An area enclosed by the wall of the housing 60 in the preliminary stirring path 84 and extending toward the stirring path 82 from an intersection K3 where the wall surface of the housing 60 and the line S3 meet is defined as the allowance area R1 of the preliminary stirring path 84. If the wall surface of the housing does not reach a position where the line S3 would meet the wall surface, the intersection K3 is defined as a point where a virtual wall surface extended from the actual wall surface of the housing and the line S3 meet.

Preliminary Member 90

Referring to FIG. 3, the preliminary member 90 includes the extension shaft 90*a* provided by extending an end of the stirring shaft 88*a* that is on the far side in the apparatus depth direction, and a helical transporting blade 92 provided around the extension shaft 90*a*. The direction of the helix of the transporting blade 92 is the same as that of the stirring blade 88*b*.

Referring to FIG. 1, the transporting blade 92 is divided into a first transporting blade 94 and a second transporting blade 96 in the allowance area R1 of the preliminary stirring path 84. The first transporting blade 94 is provided on a side nearer to the stirring blade 88*b*. The second transporting blade 96 is provided across the first transporting blade 94 from the stirring blade 88*b*. In other words, the first transporting blade 94 and the second transporting blade 96 are aligned with each other and are spaced apart from the stirring blade 88*b* in that order in the apparatus depth direction.

In the present exemplary embodiment, the outside diameters of the first transporting blade 94 and the second transporting blade 96 are the same as the outside diameter of the stirring blade 88*b*, and the pitches of the first transporting blade 94 and the second transporting blade 96 are the same as the pitch of the stirring blade 88*b*.

A portion of the first transporting blade 94 that is on a side nearer to the stirring blade 88*b* extends into the stirring path 82, reaching the outer peripheral surface of the stirring shaft 88*a*. Seen in the axial direction, an end surface 94*a* of the first transporting blade 94 that is on the side nearer to the stirring blade 88*b* extends in the radial direction of the stirring shaft 88*a*. The end surface 94*a* of the first transporting blade 94 and the end surface 89 of the stirring blade 88*b* are spaced apart from each other in the peripheral direction of the stirring shaft 88*a*. In other words, in the peripheral direction of the stirring shaft 88*a*, there is an area where a peripheral surface 87 of the stirring shaft 88*a* spreads continuously between the end surface 94*a* of the first transporting blade 94 and the end surface 89 of the stirring blade 88*b*. The end surface 94*a* is an exemplary end part.

As described above, the stirring blade 88*b* and the first transporting blade 94 are separate from each other. Specifically, the stirring blade 88*b* and the first transporting blade 94 are spaced apart from each other at a position on a side nearer to the supplying blade 74*b* with respect to the reversal blade 74*c* in the apparatus depth direction (the axial direction) and in an area that faces the passageway 86*a* in the apparatus width direction (the direction in which the supply path 80 and the stirring path 82 are side by side).

Furthermore, seen in the axial direction of the stirring shaft 88*a*, the direction in which the end surface 94*a* of the first transporting blade 94 extends and the direction in which the end surface 89 of the stirring blade 88*b* extends intersect each other. In the present exemplary embodiment, seen in the axial direction of the stirring shaft 88*a*, the angle formed between the direction in which the end surface 94*a* of the first transporting blade 94 extends and the direction in which the end surface 89 of the stirring blade 88*b* extends is 90 degrees (see FIGS. 7A and 7B).

As described above, the end surface 89 of the stirring blade 88*b* and the end surface 94*a* of the first transporting blade 94 are spaced apart from each other in the peripheral direction of the stirring shaft 88*a*, whereby the stirring blade 88*b* and the first transporting blade 94 are out of phase. In other words, even if the stirring blade 88*b* is extended up to the first transporting blade 94, the extended portion and the first transporting blade 94 do not match in the peripheral direction of the stirring shaft 88*a*. Herein, the expression "being spaced apart in the peripheral direction" refers to a state where the end surface 89 of the stirring blade 88*b* and the end surface 94*a* of the first transporting blade 94 are spaced apart from each other in the peripheral direction of the stirring shaft 88*a* with a gap between the tips thereof in the axial direction of the stirring shaft 88*a* being 2 mm or smaller, considering errors in the shaping process and the like of relevant components.

In such a configuration, the toner T transported by the first transporting blade 94 temporarily decelerates between the first transporting blade 94 and the stirring blade 88*b*. That is, the area between the first transporting blade 94 and the stirring blade 88*b* is defined as a temporary deceleration area where the toner T that is being transported temporarily decelerates.

The stirring shaft 88*a* is provided with a pair of plate-like members 106 between the end surface 89 of the stirring blade 88*b* and the end surface 94*a* of the first transporting blade 94 in the peripheral direction thereof. The plate-like members 106 project from the peripheral surface 87 of the stirring shaft 88*a*. In the axial direction of the stirring shaft 88*a*, at least part of the plate-like members 106 is present in an area between the base of the end surface 89 and the base of the end surface 94*a*. The plate-like members 106 are each an exemplary another plate-like member.

The pair of plate-like members 106 are arranged side by side in the apparatus depth direction and project in the radial direction of the stirring shaft 88*a* from the peripheral surface 87. The major surface of each of the plate-like members 106 has a rectangular shape extending in the radial direction of the stirring shaft 88*a* and faces against the peripheral direction of the stirring shaft 88*a*. The height of the plate-like members 106 from the peripheral surface 87 of the stirring shaft 88*a* is the same as the height of the stirring blade 88*b* from the peripheral surface 87 of the stirring shaft 88*a*.

The stirring shaft 88*a* is provided with another pair of plate-like members 108 projecting from a side of the peripheral surface 87 that is opposite the pair of plate-like members 106. The pair of plate-like members 108 each have the same shape as the pair of plate-like members 106.

Seen in the axial direction, an end surface 94*b* of the first transporting blade 94 that is on a side nearer to the second transporting blade 96 extends in the radial direction of the extension shaft 90*a*, and an end surface 96*a* of the second transporting blade 96 that is on a side nearer to the first transporting blade 94 extends in the radial direction of the extension shaft 90*a*. The end surface 94*b* and the end surface 96*a* are each an exemplary end part.

The end surface 96*a* of the second transporting blade 96 and the end surface 94*b* of the first transporting blade 94 are spaced apart from each other in the peripheral direction of the extension shaft 90*a*. Seen in the axial direction of the extension shaft 90*a*, the direction in which the end surface 96*a* of the second transporting blade 96 extends and the direction in which the end surface 94*b* of the first transporting blade 94 extends intersect each other. In the present exemplary embodiment, seen in the axial direction of the extension shaft 90*a*, the angle formed between the direction in which the end surface 96*a* of the second transporting blade 96 extends and the direction in which the end surface 94*b* of the first transporting blade 94 extends is 90 degrees (see FIGS. 8A and 8B).

As described above, the end surface 94*b* of the first transporting blade 94 and the end surface 96*a* of the second transporting blade 96 are spaced apart from each other in the peripheral direction of the extension shaft 90*a*, whereby the first transporting blade 94 and the second transporting blade 96 are out of phase. In other words, even if the first transporting blade 94 is extended up to the second transporting blade 96, the extended portion and the second transporting blade 96 do not match in the peripheral direction of the extension shaft 90*a*. Herein, the expression "being spaced apart in the peripheral direction" refers to a state where the end surface 94*b* of the first transporting blade 94 and the end surface 96*a* of the second transporting blade 96 are spaced apart from each other in the peripheral direction of the extension shaft 90*a* with a gap between the tips thereof in the axial direction of the extension shaft 90*a* being 2 mm or smaller, considering errors in the shaping process and the like of relevant components.

In such a configuration, the toner T transported by the second transporting blade 96 temporarily decelerates between the first transporting blade 94 and the second transporting blade 96. That is, the area between the first transporting blade 94 and the second transporting blade 96 is defined as a temporary deceleration area where the toner T that is being transported temporarily decelerates.

Figure 2:
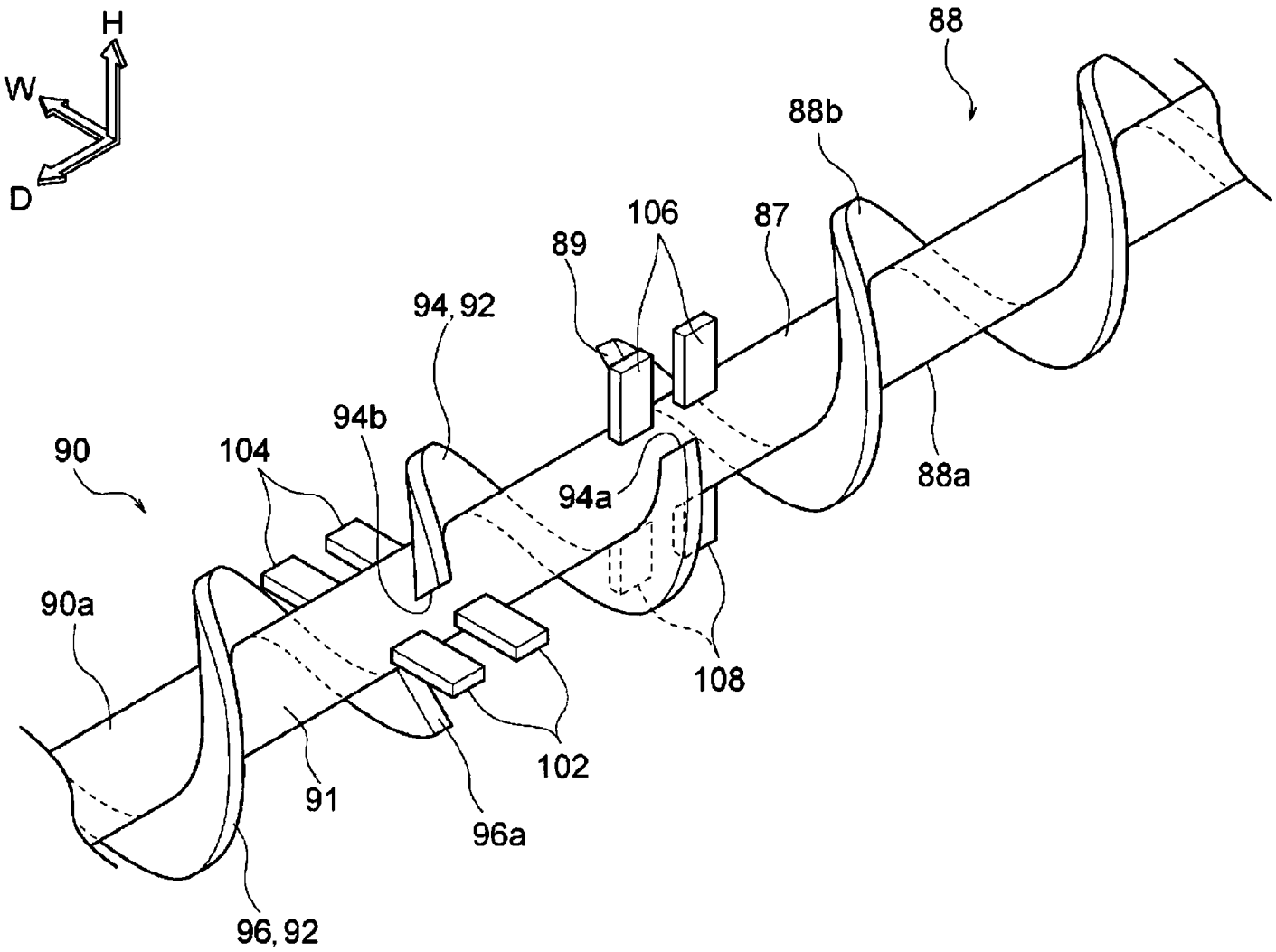
FIG. 2 is an enlarged perspective view of part of a preliminary member provided in the preliminary stirring path of the developing device according to the exemplary embodiment of the present disclosure.

Referring to FIGS. 1 and 2, the extension shaft 90*a* is provided with a pair of plate-like members 102 between the end surface 94*b* of the first transporting blade 94 and the end surface 96*a* of the second transporting blade 96 in the peripheral direction thereof. The plate-like members 102 project from a peripheral surface 91 of the extension shaft 90*a*. In the axial direction of the extension shaft 90*a*, at least part of each of the plate-like members 102 is present in an area between the base of the end surface 94*b* and the base of the end surface 96*a*.

The pair of plate-like members 102 are arranged side by side in the apparatus depth direction and project in the radial direction of the extension shaft 90*a* from the peripheral surface 91. The major surface of each of the plate-like members 102 has a rectangular shape extending in the radial direction of the extension shaft 90*a* and faces against the peripheral direction of the extension shaft 90*a*. The height of the plate-like members 102 from the peripheral surface 91 of the extension shaft 90*a* is the same as the height of the transporting blade 92 from the peripheral surface 91 of the extension shaft 90*a*.

The extension shaft 90*a* is provided with another pair of plate-like members 104 projecting from a side of the peripheral surface 91 that is opposite the pair of plate-like members 102. The pair of plate-like members 104 each have the same shape as the pair of plate-like members 102.

Functions of Featured Elements

Functions of the developing device 40 will now be described.

In an area of the housing 60 of the developing device 40 illustrated in FIG. 3 where the stirring member 88 is provided, the rotating stirring member 88 that is stirring the developer G transports the developer G received from the supplying member 74 through the passageway 86*a* provided on the far side in the apparatus depth direction. Specifically, the rotating stirring member 88 that is stirring the developer G transports the developer G from the far side toward the near side in the apparatus depth direction.

The developer G transported by the stirring member 88 is stopped by the wall surface of the housing 60. Hence, the rotating stirring member 88 delivers the developer G to the supplying member 74 through the passageway 86*b* provided on the near side in the apparatus depth direction.

The rotating supplying member 74 transports the developer G received as above from the near side toward the far side in the apparatus depth direction and simultaneously supplies the developer G to the developing roller 68.

The rotating supplying member 74 changes the direction of transport of the developer G and delivers the developer G to the rotating stirring member 88 through the passageway 86*a*. Thus, the developer G circulates between the supply path 80 and the stirring path 82 (as represented by the arrows in FIG. 3).

The developer G supplied to the developing roller 68 illustrated in FIG. 5 is held on the surface of the developing roller 68 in the form of a magnetic brush (not illustrated), with the magnetic force generated by the magnet roller 68*b*. The rotating sleeve 68*a* transports the developer G to a position facing the image carrier 36. Then, the toner T contained in the developer G transported to the position facing the image carrier 36 is attracted to the electrostatic latent image on the image carrier 36, whereby the electrostatic latent image is visualized as a toner image.

Meanwhile, referring to FIG. 3, some of the developer G that is moving from the rotating supplying member 74 toward the stirring path 82 through the passageway 86*a* is not delivered to the stirring member 88 but advances into the allowance area R1 (see FIG. 4) provided in the preliminary stirring path 84.

In the above process, when the controller 44 (see FIG. 6) receives, from a detector (not illustrated), information notifying a reduction in the amount of toner T contained in the developer G circulating between the supply path 80 and the stirring path 82, the controller 44 causes fresh toner T stored in a storage unit to be supplied to the preliminary stirring path 84 through the toner supply port 62 illustrated in FIG. 1.

A portion of the rotating preliminary member 90 where the second transporting blade 96 is provided transports the fresh toner T and the developer G advanced into the allowance area R1 of the preliminary stirring path 84 toward the stirring path 82. The toner T and the developer G transported by the second transporting blade 96 temporarily decelerate before reaching the first transporting blade 94 that is spaced apart from the second transporting blade 96.

The toner T and the developer G thus decelerated and stopped are stirred by a portion of the rotating preliminary member 90, specifically, by a portion of the second transporting blade 96 that is on a side nearer to the first transporting blade 94, a portion of the first transporting blade 94 that is on a side nearer to the second transporting blade 96, and the plate-like members 102 and 104. The toner T and the developer G thus stirred are pushed by the toner T and the developer G transported by the portion of the rotating preliminary member 90 where the second transporting blade 96 is provided, and are moved toward the first transporting blade 94.

The toner T and the developer G moved toward the first transporting blade 94 are further transported toward the stirring path 82 by a portion of the rotating preliminary member 90 where the first transporting blade 94 is provided. The toner T and the developer G transported by the first transporting blade 94 temporarily decelerate before reaching the stirring blade 88*b* that is spaced apart from the first transporting blade 94.

The toner T and the developer G thus decelerated and stopped are stirred by a portion of the rotating preliminary member 90 and a portion of the rotating stirring member 88, specifically, by a portion of the first transporting blade 94 that is on a side nearer to the stirring blade 88*b*, a portion of the stirring blade 88*b* that is on a side nearer to the first transporting blade 94, and the plate-like members 106 and 108. The developer G thus stirred is pushed by the toner T and the developer G transported by the portion of the rotating preliminary member 90 where the first transporting blade 94 is provided, and is moved toward the stirring blade 88*b*.

The developer G thus moved toward the stirring blade 88*b* is stirred and simultaneously transported by the rotating stirring member 88 toward the near side in the apparatus depth direction.

Evaluation

An evaluation made for each of the developing device 40 according to the present exemplary embodiment and a developing device 240 according to a comparative embodiment will now be described. The evaluation is conducted by using a Fuji Xerox "DocuPrint C3450 d" as an image forming apparatus, with developing devices thereof exchanged between the developing devices 40 according to the above exemplary embodiment and the developing devices 240 according to the comparative embodiment. A configuration of each developing device 240 according to the comparative embodiment will first be described, focusing on differences from the developing device 40, followed by a method of the evaluation and so forth.

Developing Device 240

Figure 12:
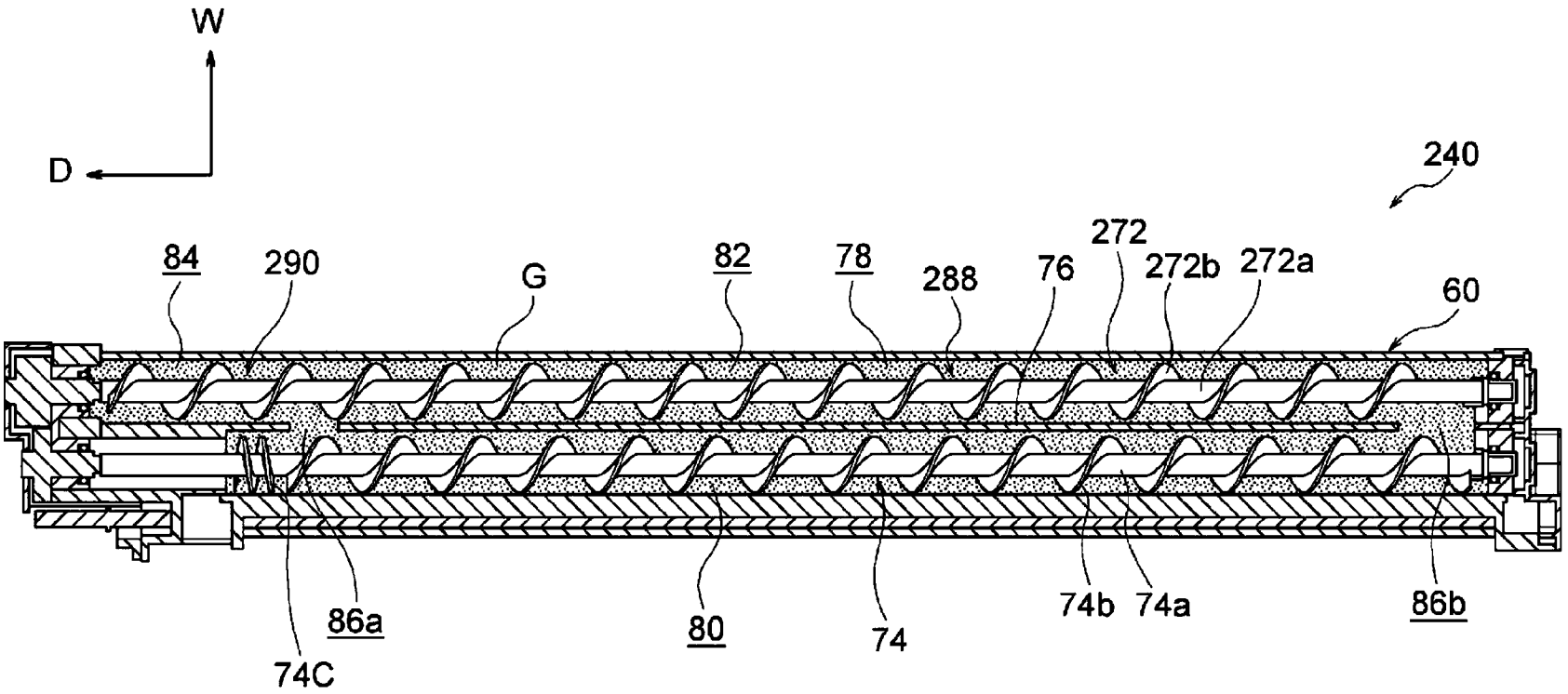
FIG. 12 is a sectional view of the developing device according to the comparative embodiment of the present disclosure, illustrating a supply path, a stirring path, the preliminary stirring path, and other relevant elements.

Referring to FIG. 12, the developing device 240 includes, in the housing 60 thereof, the supplying member 74 provided in the supply path 80, and a transporting member 272 provided in the transport path 78. The transporting member 272 includes a stirring member 288 extending in the stirring path 82, and a preliminary member 290 extending in the preliminary stirring path 84. The stirring member 288 and the preliminary member 290 have the same configuration.

Figure 11:
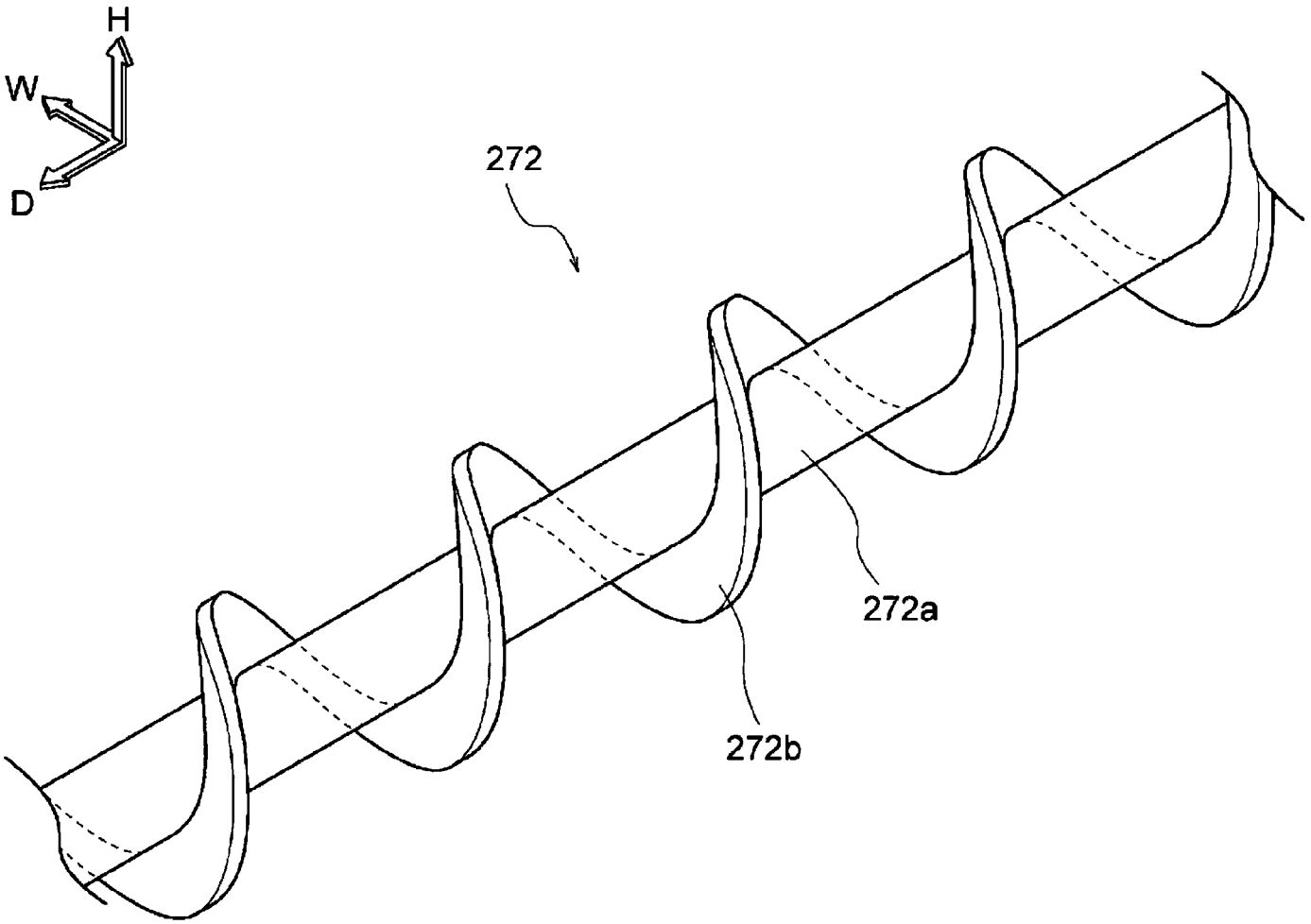
FIG. 11 is an enlarged perspective view of part of a preliminary member provided in a preliminary stirring path of the developing device according to the comparative embodiment of the present disclosure.

Specifically, the transporting member 272 includes a transporting shaft 272*a* and a helical transporting blade 272*b* provided around the transporting shaft 272*a*. The transporting shaft 272*a* extends in the apparatus depth direction in the transport path 78. The transporting blade 272*b* extends continuously from one end to the other end of the transporting shaft 272*a*. That is, the transporting blade 272*b* is not divided into plural members but is continuously provided around the transporting shaft 272*a* (see FIG. 11) in such a manner as to extend over the stirring path 82 and the preliminary stirring path 84.

The transporting shaft 272*a* and the supplying shaft 74*a* have the same outside diameter, and the transporting blade 272*b* and the supplying blade 74*b* have the same outside diameter. The pitch of the transporting blade 272*b* is the same as the pitch of the supplying blade 74*b*.

Evaluation Method and Items Evaluated

A specified amount of developer G is provided in the supply path 80 and the stirring path 82 of each of the developing devices 40 for the respective colors and the developing devices 240 for the respective colors, and 2 g of toner T is supplied into the preliminary stirring path 84 thereof. Then, the image forming apparatus is operated with each of the set of developing devices 40 and the set of developing devices 240 in the above state, and the toner density is measured for any one of the developing devices 40 (240) with a toner-density meter in an area (an area M1 illustrated in FIG. 3) of the stirring path 82 that is on the near side in the apparatus depth direction.

Results of Evaluation

Figure 9:
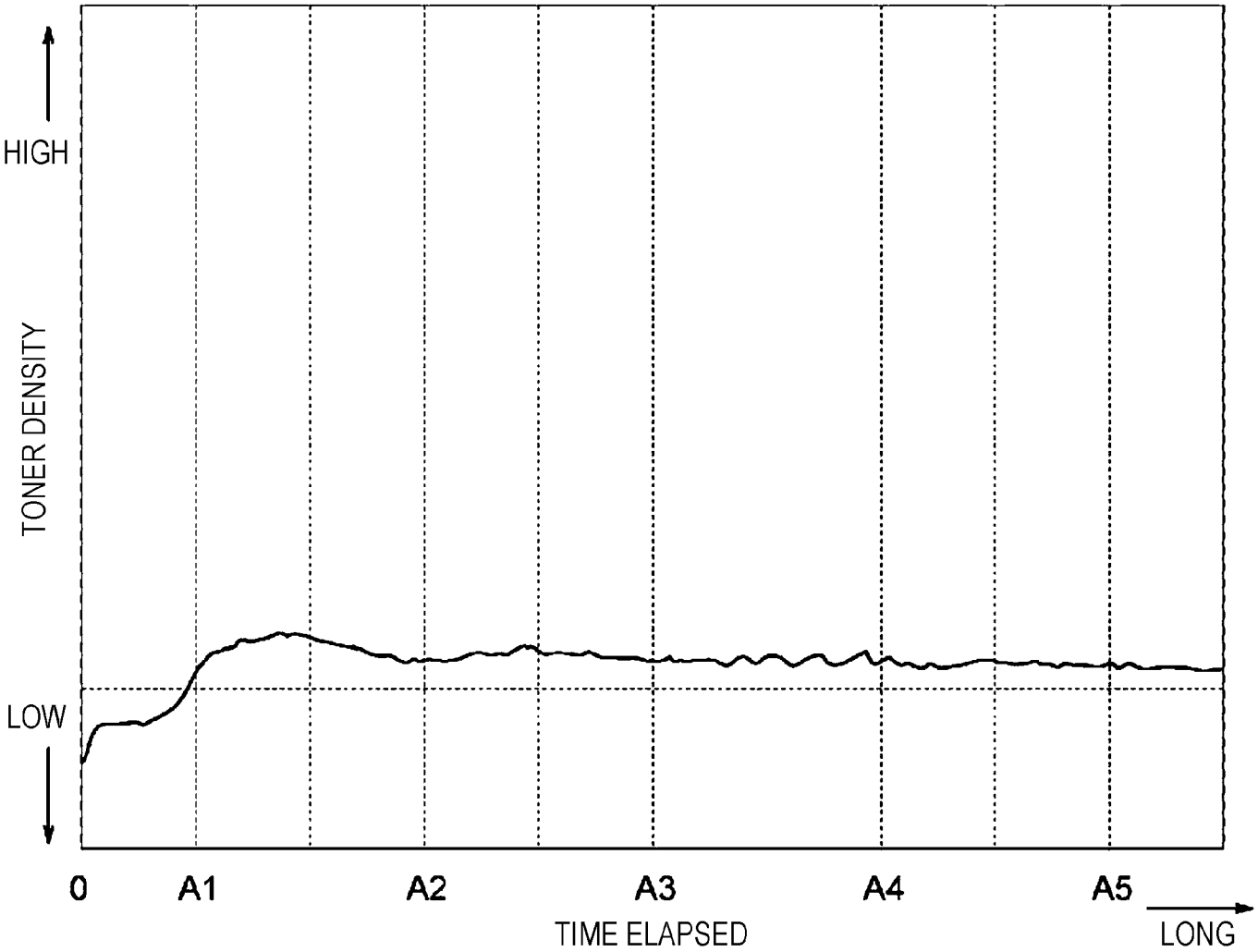
FIG. 9 is a graph illustrating the result of an evaluation of the developing device according to the exemplary embodiment of the present disclosure.
Figure 10:
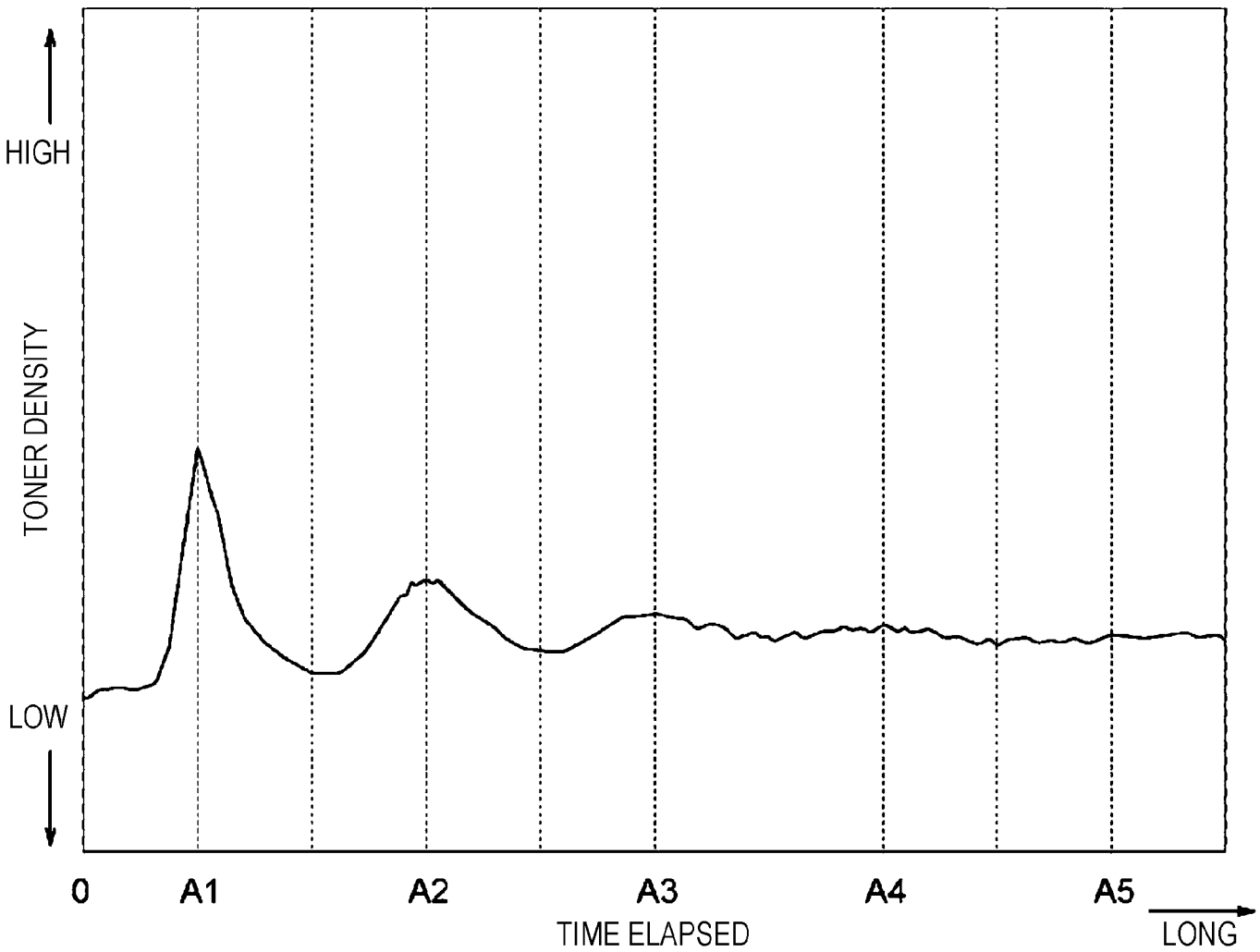
FIG. 10 is a graph illustrating the result of an evaluation of a developing device according to a comparative embodiment of the present disclosure.

FIG. 10 is a graph illustrating the result of the evaluation of the developing device 240. FIG. 9 is a graph illustrating the result of the evaluation of the developing device 40. In each of the graphs, the vertical axis represents the toner density, and the horizontal axis represents the time elapsed. Points of time A1 to A5 in each of the graphs each represent the time when the fresh toner T supplied into the preliminary stirring path 84 passes through the area M1. Specifically, the point of time A1 represents the time when the fresh toner T supplied into the preliminary stirring path 84 passes through the area M1 for the first time. The point of time A2 represents the time when the fresh toner T supplied into the preliminary stirring path 84 and circulating between the supply path 80 and the stirring path 82 passes through the area M1 for the second time. Likewise, the point of time A3 represents the time when the fresh toner T passes through the area M1 for the third time, the point of time A4 represents the time when the fresh toner T passes through the area M1 for the fourth time, and the point of time A5 represents the time when the fresh toner T passes through the area M1 for the fifth time.

As is seen from the graph illustrated in FIG. 10, in the developing device 240, the toner density increases at each of the points of time A1 to A3 when the fresh toner T passes through the area M1 for the first to third times. This shows that, at the point of time when the fresh toner T passes through the area M1 for the third time, the fresh toner T and the developer G have not been stirred sufficiently.

In contrast, in the developing device 40, as is seen from the graph illustrated in FIG. 9, the toner density increases at the point of time A1 when the fresh toner T passes through the area M1 for the first time but does not increase at the point of time A2 and thereafter. This shows that, at the point of time A2 when the fresh toner T passes through the area M1 for the second time, the fresh toner T and the developer G have been stirred sufficiently.

Discussion

The transporting blade 272*b* of the transporting member 272 included in the developing device 240 extends continuously from one end to the other end of the transporting shaft 272*a*. That is, the transporting blade 272*b* of the transporting member 272 extending over the stirring path 82 and the preliminary stirring path 84 is not divided into plural members. Therefore, it is considered that, in the developing device 240, the fresh toner T supplied into the preliminary stirring path 84 receives a strong transporting force but a weak stirring force from the rotating transporting member 272.

In contrast, the transporting member 72 of the developing device 40 includes the stirring member 88 extending in the stirring path 82 and the preliminary member 90 extending in the preliminary stirring path 84. Furthermore, the transporting blade 92 of the preliminary member 90 is divided into the first transporting blade 94 and the second transporting blade 96 in the allowance area R1 of the preliminary stirring path 84. Furthermore, the first transporting blade 94 of the preliminary member 90 and the stirring blade 88*b* of the stirring member 88 are spaced apart from each other. Furthermore, the plate-like members 102, 104, 106, and 108 are provided in the areas between the pairs of the above members. Therefore, it is considered that, in the developing device 40, the fresh toner T supplied into the preliminary stirring path 84 receives a strong stirring force but a weak transporting force from the rotating preliminary member 90.

Hence, as is seen from the above results of the evaluation, the time required for the developing device 40 to stir the fresh toner T and the developer G is shorter than for the developing device 240.

CONCLUSIONS

As described above, in the developing device 40, the transporting blade 92 is divided into the first transporting blade 94 and the second transporting blade 96. Therefore, the time required for stirring the fresh toner T and the developer G is shorter than in the developing device 240. Accordingly, the occurrence of nonuniformity in the density of the toner image is reduced.

In the developing device 40, the transporting blade 92 is divided into the first transporting blade 94 and the second transporting blade 96 in the allowance area R1 into which some of the developer G advances. Therefore, the time required for stirring the fresh toner T and the developer G is shorter than in a case where the transporting blade is divided outside the allowance area R1. Accordingly, the occurrence of nonuniformity in the density of the toner image is reduced.

In the developing device 40, the first transporting blade 94 and the second transporting blade 96 are out of phase. Therefore, the rhythm of transport of the fresh toner T and the developer G is changed. Hence, the time required for stirring the fresh toner T and the developer G is shorter than in a case where the first transporting blade and the second transporting blade are in phase. Accordingly, the occurrence of nonuniformity in the density of the toner image is reduced.

In the developing device 40, the end surface 94*b* of the first transporting blade 94 and the end surface 96*a* of the second transporting blade 96 are spaced apart from each other in the peripheral direction of the extension shaft 90*a*, whereby the first transporting blade 94 and the second transporting blade 96 are made out of phase. Therefore, the size of an area where no stirring force is received from the blade is smaller than in a case where the first transporting blade 94 and the second transporting blade 96 are made out of phase by providing a space between the first transporting blade 94 and the second transporting blade 96 in the axial direction of the extension shaft 90*a*. Accordingly, the time required for stirring the fresh toner T and the developer G is reduced, and the occurrence of nonuniformity in the density of the toner image is reduced.

In the developing device 40, the plate-like members 102 project from the peripheral surface 91 of the extension shaft 90*a* between the end surface 94*b* of the first transporting blade 94 and the end surface 96*a* of the second transporting blade 96 in the peripheral direction of the extension shaft 90*a*. Therefore, the time required for stirring the fresh toner T and the developer G is shorter than in a case where a continuously smooth curved surface extends between the end surface 94*b* of the first transporting blade 94 and the end surface 96*a* of the second transporting blade 96 in the peripheral direction of the extension shaft 90*a*. Accordingly, the occurrence of nonuniformity in the density of the toner image is reduced.

In the developing device 40, the major surface of each of the plate-like members 102 faces against the peripheral direction of the extension shaft 90*a*. Therefore, the time required for stirring the fresh toner T and the developer G is shorter than in a case where the major surface of each of the plate-like members is oblique with respect to the peripheral direction of the extension shaft. Accordingly, the occurrence of nonuniformity in the density of the toner image is reduced.

In the developing device 40, the stirring blade 88*b* and the first transporting blade 94 are spaced apart from each other at a position on a side nearer to the supplying blade 74*b* with respect to the reversal blade 74*c* in the apparatus depth direction and in an area that faces the passageway 86*a* in the apparatus width direction. Therefore, the time required for stirring the fresh toner T and the developer G is shorter than in a case where the position where the stirring blade 88*b* and the first transporting blade 94 are spaced apart from each other is shifted from the area facing the passageway 86*a* in the apparatus depth direction (the axial direction). Accordingly, the occurrence of nonuniformity in the density of the toner image is reduced.

In the developing device 40, the stirring blade 88*b* and the first transporting blade 94 are spaced apart from each other at the position on the side nearer to the supplying blade 74*b* with respect to the reversal blade 74*c* in the apparatus depth direction and in the area that faces the passageway 86*a* in the apparatus width direction. Therefore, the toner T and the developer G transported by the first transporting blade 94 temporarily decelerate and stop before reaching the stirring blade 88*b* that is spaced apart from the first transporting blade 94. Hence, the amount of toner T and the developer G stirred in the preliminary stirring path 84 is greater than in a case where the toner T and the developer G do not temporarily decelerate. In other words, since the developer G stops, more toner T and more developer G received from the supplying member 74 are pushed toward the preliminary stirring path and are subjected to supplemental stirring.

In the developing device 40, the stirring blade 88*b* and the first transporting blade 94 are out of phase. Therefore, the rhythm of transport of the fresh toner T and the developer G is changed. Hence, the time required for stirring the fresh toner T and the developer G is shorter than in a case where the stirring blade and the first transporting blade are in phase. Accordingly, the occurrence of nonuniformity in the density of the toner image is reduced.

In the developing device 40, the end surface 89 of the stirring blade 88*b* and the end surface 94*a* of the first transporting blade 94 are spaced apart from each other in the peripheral direction of the stirring shaft 88*a*, whereby the stirring blade 88*b* and the first transporting blade 94 are made out of phase. Therefore, the size of an area where no stirring force is received from the blade is smaller than in a case where the stirring blade 88*b* and the first transporting blade 94 are made out of phase by providing a space between the stirring blade 88*b* and the first transporting blade 94 in the axial direction of the stirring shaft 88*a*. Accordingly, the time required for stirring the fresh toner T and the developer G is reduced, and the occurrence of nonuniformity in the density of the toner image is reduced.

In the developing device 40, the plate-like members 106 project from the peripheral surface 87 of the stirring shaft 88*a* between the end surface 89 of the stirring blade 88*b* and the end surface 94*a* of the first transporting blade 94 in the peripheral direction of the stirring shaft 88*a*. Therefore, the time required for stirring the fresh toner T and the developer G is shorter than in a case where a continuously smooth curved surface extends between the end surface 89 of the stirring blade 88*b* and the end surface 94*a* of the first transporting blade 94 in the peripheral direction of the stirring shaft 88*a*. Accordingly, the occurrence of nonuniformity in the density of the toner image is reduced.

In the developing device 40, the major surface of each of the plate-like members 106 faces against the peripheral direction of the stirring shaft 88*a*. Therefore, the time required for stirring the fresh toner T and the developer G is shorter than in a case where the major surface of each of the plate-like members is oblique with respect to the peripheral direction of the stirring shaft 88*a*. Accordingly, the occurrence of nonuniformity in the density of the toner image is reduced.

The image forming apparatus 10 includes the developing device 40. Therefore, the occurrence of nonuniformity in the density of the output image is reduced more than in a case where the image forming apparatus 10 includes the developing device 240.

While a specific exemplary embodiment of the present disclosure has been described in detail, the present disclosure is not limited to the above exemplary embodiment. It is obvious to those skilled in the art that various other embodiments are conceivable within the scope of the present disclosure. For example, while the above exemplary embodiment concerns a case where fresh toner T is supplied from the toner supply port 62, fresh toner T and fresh carrier C may be supplied from a supply port.

The above exemplary embodiment concerns a case where the transporting blade 92 is divided into plural members in the allowance area R1. Alternatively, the transporting blade 92 may be divided outside the allowance area R1. In that case, the effect produced by dividing the transporting blade 92 in the allowance area R1 is not produced.

The above exemplary embodiment concerns a case where the first transporting blade 94 and the second transporting blade 96 are out of phase. Alternatively, the first transporting blade 94 and the second transporting blade 96 may be in phase. In that case, the effect produced by the first transporting blade 94 and the second transporting blade 96 that are out of phase is not produced.

The above exemplary embodiment concerns a case where the first transporting blade 94 and the second transporting blade 96 are made out of phase by providing a space between the end surface 94*b* of the first transporting blade 94 and the end surface 96*a* of the second transporting blade 96 in the peripheral direction of the extension shaft 90*a*. Alternatively, the first transporting blade and the second transporting blade may be made out of phase by providing a space between the two in the axial direction of the extension shaft 90*a*. In that case, the effect produced by the first transporting blade 94 and the second transporting blade 96 that are made out of phase by providing a space between the end surface 94*b* of the first transporting blade 94 and the end surface 96*a* of the second transporting blade 96 in the peripheral direction of the extension shaft 90*a* is not produced.

The above exemplary embodiment concerns a case where the stirring blade 88*b* and the first transporting blade 94 are out of phase. Alternatively, the stirring blade 88*b* and the first transporting blade 94 may be in phase. In that case, the effect produced by the stirring blade 88*b* and the first transporting blade 94 that are out of phase is not produced.

The above exemplary embodiment concerns a case where the stirring blade 88*b* and the first transporting blade 94 are made out of phase by providing a space between the end surface 89 of the stirring blade 88*b* and the end surface 94*a* of the first transporting blade 94 in the peripheral direction of the stirring shaft 88*a*. Alternatively, the stirring blade and the first transporting blade may be made out of phase by providing a space between the two in the axial direction of the stirring shaft 88*a*. In that case, the effect produced by the stirring blade 88*b* and the first transporting blade 94 that are made out of phase by providing a space between the end surface 89 of the stirring blade 88*b* and the end surface 94*a* of the first transporting blade 94 in the peripheral direction of the stirring shaft 88*a* is not produced.

The thickness of each of the plate-like members 102, 104, 106, and 108 has not been described specifically in the above exemplary embodiment. The thickness of each of the plate-like members 102, 104, 106, and 108 may be uniform or be varied from the base to the tip thereof.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a rotating member that delivers developer to a latent image on an image carrier while rotating;

a supplying member provided in a supply path extending in an axial direction of the rotating member;

a stirring member including a stirring shaft extending in the axial direction and provided in a stirring path extending in the axial direction and arranged side by side with the supply path in a direction intersecting the axial direction, the stirring member stirring the developer while rotating by causing the developer to circulate between the supply path and the stirring path; and a preliminary member provided in a preliminary stirring path into which toner is supplied from an outside and provided by extending an end of the stirring path that is on a side where the developer delivered from the supply member is received by the stirring member, the preliminary member including an extension shaft as an extension of the stirring shaft and a helical transporting blade provided on the extension shaft, the transporting blade being divided into a first transporting blade and a second transporting blade provided across the first transporting blade from the stirring shaft by providing a space between an end part of the first transporting blade and an end part of the second transporting blade in a peripheral direction of the extension shaft, the preliminary member transporting the toner into the stirring path while rotating.

2. The developing device according to claim 1, wherein the transporting blade is divided in an allowance area included in the preliminary stirring path and into which the developer transported from the supply path advances.

3. The developing device according to claim 1, wherein a pitch of the first transporting blade and a pitch of the second transporting blade are equal, and the first transporting blade and the second transporting blade are out of phase.

4. The developing device according to claim 2, wherein a pitch of the first transporting blade and a pitch of the second transporting blade are equal, and the first transporting blade and the second transporting blade are out of phase.

5. The developing device according to claim 3, wherein the first transporting blade and the second transporting blade are made out of phase by providing the space between the end part of the first transporting blade and the end part of the second transporting blade in the peripheral direction of the extension shaft.

6. The developing device according to claim 5, wherein a plate-like member projects from a peripheral surface of the extension shaft in a radial direction of extension shall and between the end part of the first transporting blade and the end part of the second transporting blade in the peripheral direction of the extension shaft.

7. The developing device according to claim 6, wherein a major surface of the plate-like member faces against the peripheral direction.

8. The developing device according to claim 1, wherein the supplying member includes a supplying shaft extending in the axial direction and a helical supplying blade provided on the supplying shaft, wherein the stirring member includes the stirring shaft and a helical stirring blade provided on the stirring shaft, wherein the developing device includes a partition member that separates the supply path and the stirring path from each other, the partition member being provided between a pair of openings through which the developer is delivered from the supplying member to the stirring member and from the stirring member to the supplying member, respectively, wherein the supplying shaft is provided with a reversal blade that is helical in a direction opposite to a direction in which the supplying blade is helical, the reversal blade being aligned with the supplying blade in the axial direction, and wherein the stirring blade and the first transporting blade are spaced apart from each other on a side nearer to the supplying blade with respect to the reversal blade in the axial direction and in an area facing one of the openings in a direction intersecting the axial direction.

9. The developing device according to claim 8, wherein a pitch of the stirring blade and a pitch of the first transporting blade are equal, and the stirring blade and the first transporting blade are out of phase.

10. The developing device according to claim 9, wherein the stiffing blade and the first transporting blade are made out of phase by providing a space between an end part of the stirring blade and an end part of the first transporting blade in a peripheral direction of the stirring shaft.

11. The developing device according to claim 10, wherein a projecting plate-like member projects from a peripheral surface of the stirring shaft in a radial direction of the stirring shaft and between the end part of the stirring blade and the end part of the first transporting blade in the peripheral direction of the stirring shaft.

12. The developing device according to claim 11, wherein a major surface of the projecting plate-like member faces against the peripheral direction.

13. An image forming apparatus comprising:

an image carrier that carries a latent image; and the developing device according to claim 1 that develops the latent image on the image carrier.

14. A developing device comprising:

a rotating member that delivers developer to a latent image on an image carrier while rotating;

a supplying member provided in a supply path extending in an axial direction of the rotating member;

a stirring member including a stirring shaft extending in the axial direction and provided in a stirring path extending in the axial direction and arranged side by side with the supply path in a direction intersecting the axial direction, the stirring member stirring the developer while rotating by causing the developer to circulate between the supply path and the stirring path; and a preliminary member provided in a preliminary stirring path into which toner is supplied from an outside and provided by extending an end of the stirring path that is on a side where the developer delivered from the supply member is received by the stirring member, the preliminary member including an extension shaft as an extension of the stilling shaft and a helical transporting blade provided on the extension shaft, the transporting blade being divided into a first transporting blade and a second transporting blade provided across the first transporting blade from the stirring shaft, the preliminary member transporting the toner into the stirring path while rotating, a pitch of the first transporting blade and a pitch of the second transporting blade are equal, and the first transporting blade and the second transporting blade are out of phase.

* * * * *